US011162498B2

(12) United States Patent
Chang et al.

(10) Patent No.: US 11,162,498 B2
(45) Date of Patent: Nov. 2, 2021

(54) FAN

(71) Applicant: DELTA ELECTRONICS, INC., Taoyuan (TW)

(72) Inventors: Shun-Chen Chang, Taoyuan (TW); Chao-Fu Yang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 16/436,575

(22) Filed: Jun. 10, 2019

(65) Prior Publication Data

US 2020/0124051 A1 Apr. 23, 2020

(30) Foreign Application Priority Data

Oct. 23, 2018 (CN) ..... 201811281520.9

(51) Int. Cl.

| | |
|---|---|
| ***F04D 19/00*** | (2006.01) |
| ***F04D 29/52*** | (2006.01) |
| ***F04D 29/38*** | (2006.01) |
| ***F04D 25/06*** | (2006.01) |

(52) U.S. Cl.

CPC ..... *F04D 19/002* (2013.01); *F04D 25/064* (2013.01); *F04D 29/38* (2013.01); *F04D 29/522* (2013.01)

(58) Field of Classification Search

CPC ..... F04D 19/002; F04D 19/00; F04D 29/38; F04D 25/064

USPC ..... 415/219.1

See application file for complete search history.

(56) References Cited

U.S. PATENT DOCUMENTS

| | | | | |
|---|---|---|---|---|
| 8,007,232 | B2 * | 8/2011 | Hwang | F04D 29/281 415/206 |
| 8,029,236 | B2 * | 10/2011 | Chang | F04D 29/544 415/199.5 |
| 2010/0117468 | A1 * | 5/2010 | Kurita | F04D 19/002 310/71 |
| 2014/0356149 | A1 | 12/2014 | Chang et al. | |

FOREIGN PATENT DOCUMENTS

| | | | |
|---|---|---|---|
| CN | 1223027 | A | 7/1999 |
| CN | 104121230 | A | 10/2014 |
| CN | 204628094 | U | 9/2015 |

* cited by examiner

*Primary Examiner* — Michael L Sehn

(74) *Attorney, Agent, or Firm* — Muncy, Geissler, Olds & Lowe, P.C.

(57) ABSTRACT

A fan includes a frame, an impeller and a motor. The frame includes a base, a frame housing and a plurality of static blades. The frame housing includes an outlet. The static blades are disposed around the outer periphery of the base and connect between the base and the frame housing. A distance is provided between the outlet and the ends of the static blades located adjacent to the outlet, and the static blades are not protruding from the outlet. The impeller includes a hub and a plurality of rotor blades. The hub has a curved surface. The slopes of the straight lines connecting any two points on the curved surface are not equal. The rotor blades are disposed around the outer periphery of the hub. The motor is disposed on the base, and connects with and drives the impeller to rotate.

14 Claims, 14 Drawing Sheets

FAN

CROSS REFERENCE TO RELATED APPLICATIONS

This Non-provisional application claims priority under 35 U.S.C. § 119(a) on Patent Application No(s). 201811281520.9 filed in People's Republic of China on Oct. 23, 2018, the entire contents of which are hereby incorporated by reference.

BACKGROUND OF THE INVENTION

Field of Invention

This disclosure relates to a fan and, in particular, to a mixed flow fan with sunken static blades.

Related Art

As the performance of electronic devices continuously increases, current electronic devices generate a large amount of waste heat during operation. If the heat cannot be immediately removed from the electronic device, the temperature of the electronic device will rise, thereby causing damage to internal components and reducing the performance and lifetime of the electronic device. Fans are the heat-dissipation devices that are widely used in electronic devices. At present, those skilled in the art have developed a fan with the blades and hub having two or more unequal diameters (also referred to as a mixed flow fan). Although the mixed flow fan is convenient for the heat dissipation of electronic device, it is not easy to utilize the conventional fan design to improve the characteristics of the mixed flow fan due to the geometric shape thereof.

In addition, due to its geometric shape, the choice of the motor is also highly limited by the materials. If the silicon steel sheets are selected in the applications of high-power heat dissipation, it will be more likely to generate waste heat and accumulate in the fan. This will cause overheating inside the fan, thereby causing the burn-down of the circuit board or greatly reducing the operation performance of the fan. Moreover, the heat dissipation efficiency and lifetime of the fan are affected.

Therefore, it is desired to provide a mixed flow fan with enhanced fan characteristics for increasing the heat dissipation efficiency thereof. It is also desired to provide a mixed flow fan that can enhance the fan characteristics and increase the self-heat dissipation efficiency, thereby preventing the internal overheat, extending the lifetime of the fan, and maintaining the operation performance of the fan.

SUMMARY OF THE INVENTION

An objective of this disclosure is to provide a fan that has sunken static blades so as to enhance the fan characteristics of the mixed flow fan and decrease the generated noise. The design of sunken static blades can also increase the density of the static blades in the mixed flow fan, thereby further improving the fan characteristics. In addition, this disclosure also provides another fan that can enhance the fan characteristics of the mixed flow fan and increase the self-heat dissipation efficiency, thereby extending the lifetime of the fan and maintaining the operation performance of the fan.

This disclosure provides a fan comprising a frame, an impeller and a motor. The frame comprises a base, a frame housing and a plurality of static blades. The frame housing comprises an outlet, and the static blades are disposed around an outer periphery of the base and connect between the base and the frame housing. A distance is defined between the outlet and ends of the static blades located adjacent to the outlet, and the static blades are not protruding from the outlet. The impeller comprises a hub and a plurality of rotor blades. The hub has a curved surface, and the slopes of the straight lines connecting any two points on the curved surface are not equal. The rotor blades are disposed around an outer periphery of the hub. The motor is disposed on the base, and the motor connects with and drives the impeller to rotate. The motor comprises a stator structure and a rotor structure. The rotor structure comprises a shaft, a magnetic shell and a magnetic element. One end of the shaft is connected with the magnetic shell, and the magnetic element is disposed around an inner periphery of the magnetic shell and located corresponding to the stator structure.

In one embodiment, a number of the static blades is greater than or equal to 19.

In one embodiment, a ratio of a number of the static blades to a number of the rotor blades is greater than or equal to 1.5.

In one embodiment, a ratio of a height of the static blades to a height of the rotor blades is less than or equal to 0.5.

In one embodiment, the height of the static blades is greater than or equal to 8 mm.

In one embodiment, a ratio of the distance to the height of the static blades is less than or equal to 0.5.

This disclosure also provides a fan comprising a frame, an impeller and a motor. The frame comprises a base, a frame housing and a plurality of static blades. The frame housing comprises an inlet and an outlet. The static blades are disposed around an outer periphery of the base and connect between the base and the frame housing. A distance is defined between the outlet and ends of the static blades located adjacent to the outlet, and the static blades are not protruding from the outlet. The impeller comprises a hub, a plurality of rotor blades and a plurality of guiding plates. The hub has a curved surface. The slopes of straight lines connecting any two points on the curved surface are not equal, and the hub has at least an airflow opening. The rotor blades are disposed around an outer periphery of the hub. The guiding plates are disposed around an inner periphery of the hub. The motor is disposed on the base, and the motor connects with and drives the impeller to rotate. The motor comprises a stator structure and a rotor structure. The rotor structure comprises a shaft, a magnetic shell and a magnetic element. One end of the shaft is connected with the magnetic shell. The magnetic element is disposed around an inner periphery of the magnetic shell and located corresponding to the stator structure. A top surface of the magnetic shell comprises at least an opening. Two ends of the frame housing disposed adjacent to the rotor blades have a first curved portion and a second curved portion, respectively, and curvatures of the first curved portion and the second curved portion are different. An airflow entering the fan passes through the inlet, the first curved portion, the second curved portion and the outlet sequentially.

In one embodiment, a number of the static blades is greater than or equal to 19.

In one embodiment, a ratio of a number of the static blades to a number of the rotor blades is greater than or equal to 1.5.

In one embodiment, a ratio of a height of the static blades to a height of the rotor blades is less than or equal to 0.5.

In one embodiment, the height of the static blades is greater than or equal to 8 mm.

In one embodiment, a ratio of the distance to the height of the static blades is less than or equal to 0.5.

In one embodiment, the airflow opening is disposed at a top portion of the hub.

In one embodiment, the guiding plates are separately disposed with equivalent angles.

In one embodiment, the guiding plates are separately disposed with inequivalent angles.

In one embodiment, the guiding plates have the same lengths, thicknesses, heights, or shapes.

In one embodiment, the guiding plates are different in at least one of lengths, thicknesses, heights and shapes.

In one embodiment, a radius distance between the second curved portion and an axis of the hub is greater than a radius distance between the first curved portion and the axis of the hub.

In one embodiment, the frame housing has a gradual-narrowed structure from the inlet to the first curved portion, and the gradual-narrowed structure comprises at least an arc surface, at least a curved surface, at least a planar surface, at least a slant surface, or any of their combinations.

In one embodiment, the frame housing has a gradual-expanded structure from the first curved portion to the second curved portion, and the gradual-expanded structure comprises at least an arc surface, at least a curved surface, at least a planar surface, at least a slant surface, or any of their combinations.

As mentioned above, the fan of this disclosure has a distance between the outlet and ends of the static blades located adjacent to the outlet (the static blades are sunken in the outlet). This design can enhance the fan characteristics of the mixed flow fan and reduce the operation noise. The design of sunken static blades in the outlet can also increase the density of the static blades of the mixed flow fan, thereby further improving the fan characteristics of the mixed flow fan. In addition, at least an airflow opening is formed on the hub, a plurality of guiding plates are disposed around the inner periphery of the hub, and at least an opening is disposed on the top surface of the magnetic shell. These configurations can increase the self-heat dissipation efficiency inside the fan. Moreover, the configuration of the first curved portion and the second curved portion can concentrate the airflow and apply a pressure in the radial direction. In addition, the hub is designed as a gradual-expanded shape, so that the impacts between the airflow and the internal components of the fan can be reduced. Accordingly, the internal flow field of the fan can be stable and can still provide sufficient air pressure and air quantity. This can decrease the operation noise of the fan and increase the operation performance of the fan. Compared with the conventional fan, the fan of this disclosure can enhance the fan characteristics of the mixed flow fan, decrease the operation noise, and increase the density of the static blades and the self-heat dissipation efficiency of the mixed flow fan, thereby extending the lifetime of the fan and maintaining the operation performance of the fan.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

The fan of this disclosure can enhance the fan characteristics of the mixed flow fan, increase the density of the static blades in the mixed flow fan, increase the self-heat dissipation efficiency, and reduce the generated noise of the mixed flow fan, thereby further extending the lifetime of the fan and maintaining the operation performance of the fan. The structure and features of the fan of this disclosure will be described in the following embodiments.

Figure 1:
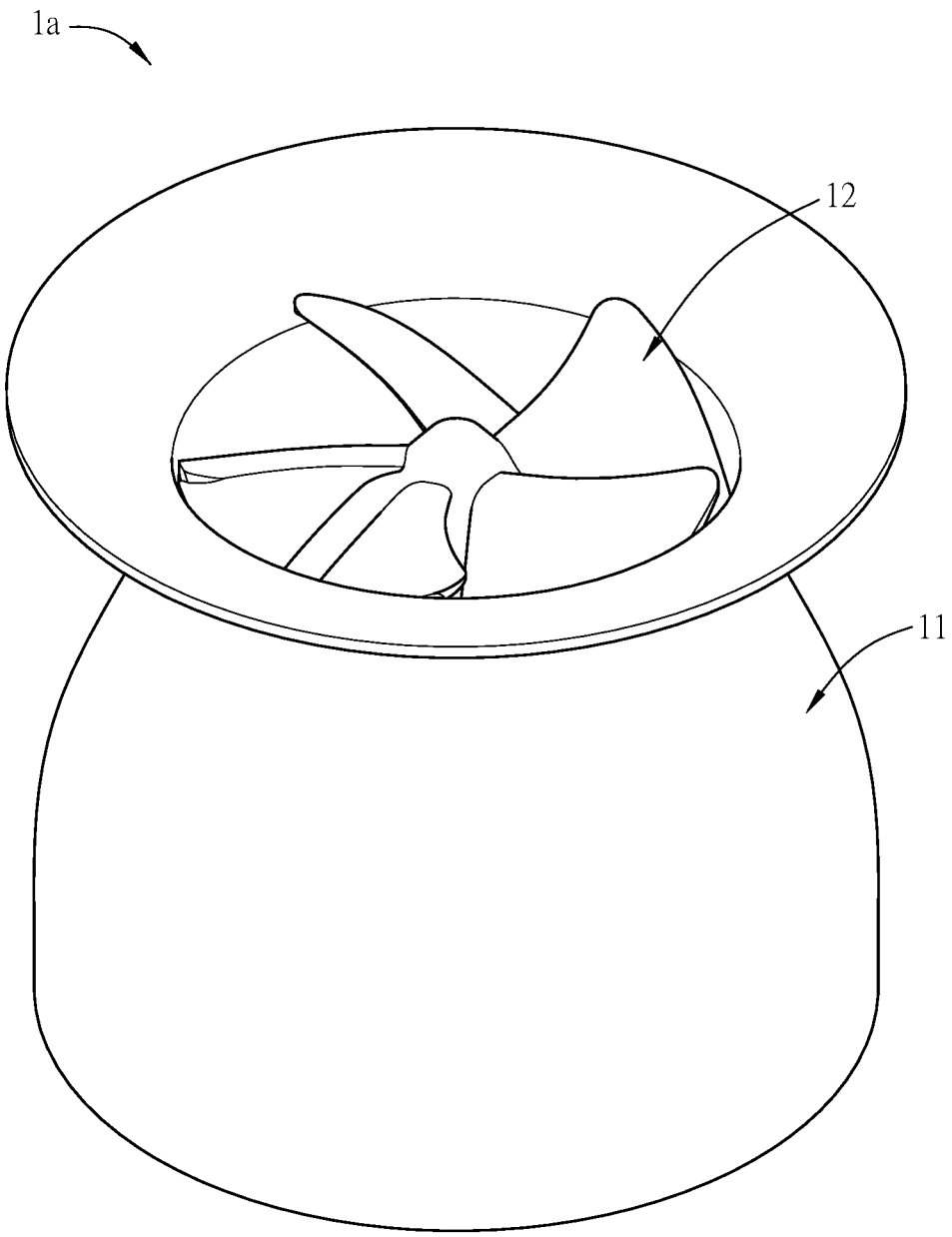
FIG. 1 is a schematic diagram showing a fan according to a first embodiment of this disclosure.
Figure 2:
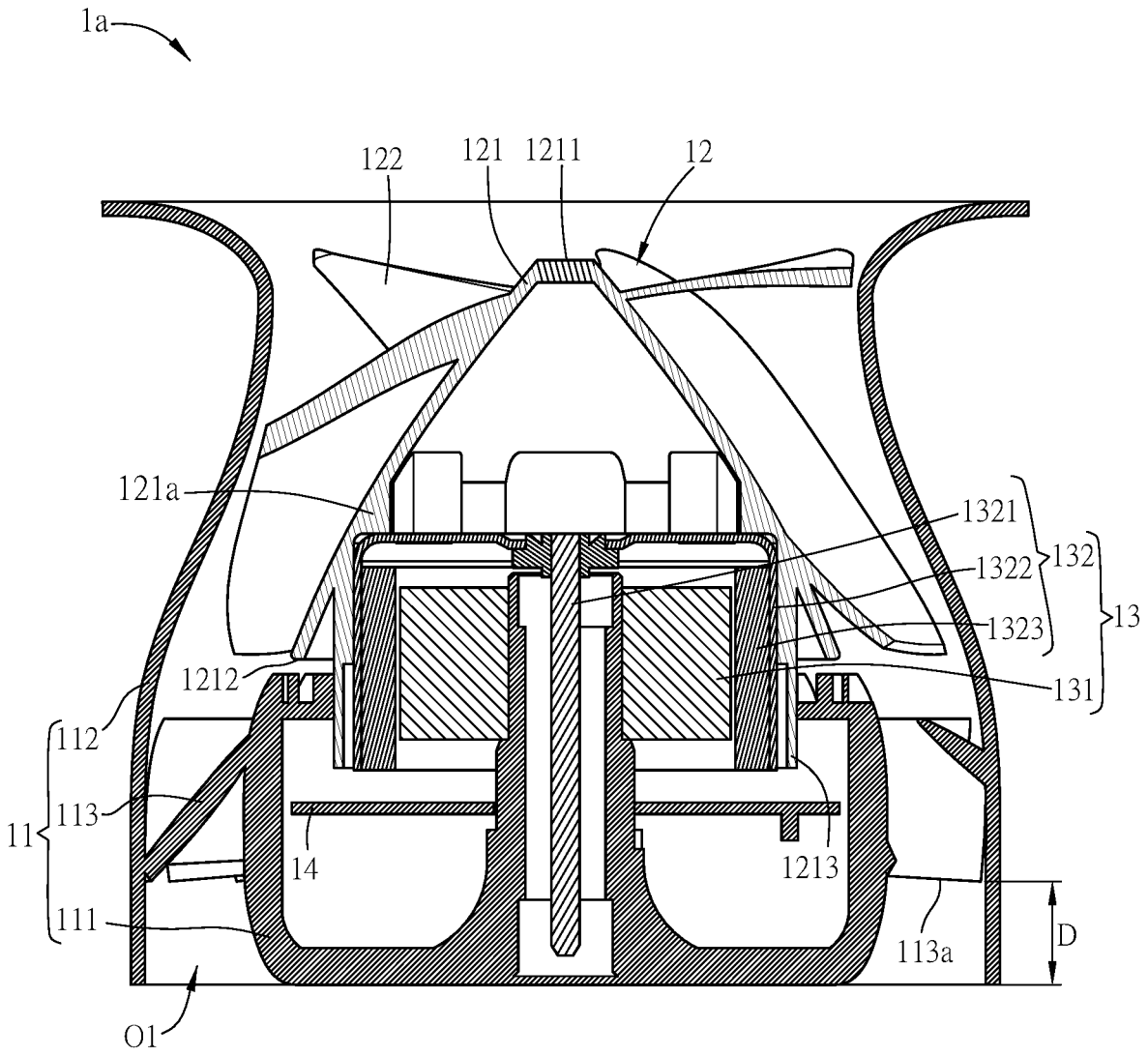
FIG. 2 is a sectional view of the fan of FIG. 1.

FIG. 1 is a schematic diagram showing a fan 1*a* according to a first embodiment of this disclosure, and FIG. 2 is a sectional view of the fan 1*a* of FIG. 1. Referring to FIGS. 1 and 2, the fan 1*a* comprises a frame 11, an impeller 12, and a motor 13. The frame 11 comprises a base 111, a frame housing 112, and a plurality of static blades 113. The frame housing 112 comprises an outlet O1, and the static blades 113 are disposed around an outer periphery of the base 111 and connect between the base 111 and the frame housing 112. A distance D is defined between the outlet O1 and the ends 113*a* of the static blades 113 located adjacent to the outlet O1, and the static blades 113 are not protruding from the outlet O1. In other words, the static blades 113 are sunken in the outlet O1. The impeller 12 comprises a hub 121 and a plurality of rotor blades 122. The hub 121 has a curved surface 121*a*, and the slopes of the straight lines connecting any two points on the curved surface 121*a* are not equal. The rotor blades 122 are disposed around an outer periphery of the hub 121. To be noted, although FIG. 2 shows that the hub 121 has a top portion 1211, a bottom portion 1212 and an extension portion 1213 protruding from the bottom portion 1212, this disclosure is not limited thereto. In some embodiments, the extension portion 1213 of the hub 121 can be aligned with the bottom portion 1212 (not shown).

Figure 3:
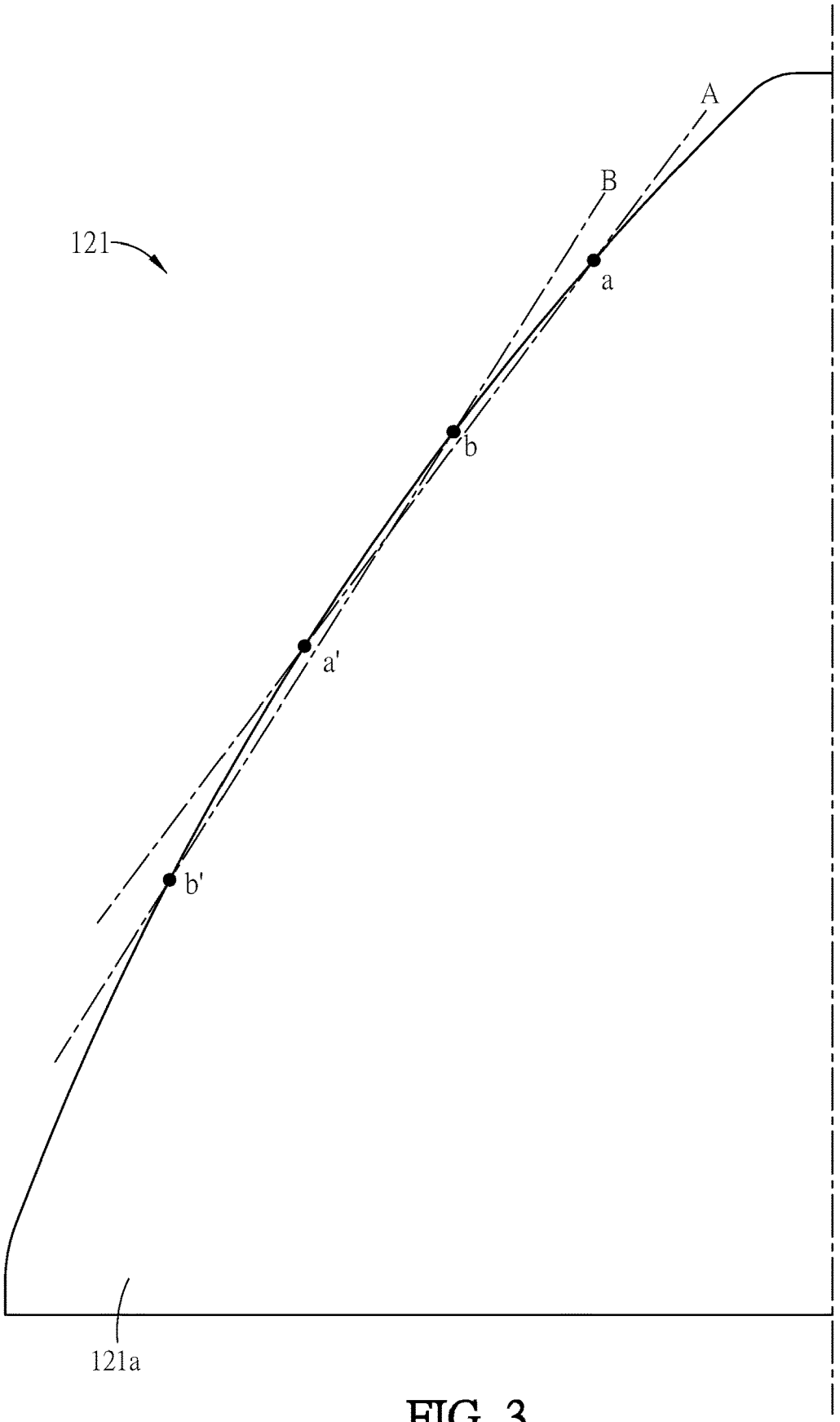
FIG. 3 is a schematic diagram showing a part of the hub of the fan of FIG. 2.

FIG. 3 is a schematic diagram showing a part of the hub of the fan of FIG. 2. FIG. 3 is used to illustrate that the slopes of the straight lines connecting any two points on the curved surface 121*a* are not equal. FIG. 3 only shows the side view of a part of the hub 121 and the curved surface 121*a* thereof, and the other components of the fan 1*a* are not shown. Referring to FIG. 3, a straight line A connects two points a and a' on the curved surface 121*a*, and a straight line B connects two points b and b' on the curved surface 121*a*. In this embodiment, the slope of the straight line A is not equal to the slope of the straight line B.

Referring to FIG. 2, in this embodiment, the motor 13 is disposed on the base 111. The motor 13 connects to the impeller 12 and drives the impeller 12 to rotate. The motor 13 comprises a stator structure 131 and a rotor structure 132. The rotor structure 132 comprises a shaft 1321, a magnetic shell 1322, and a magnetic element 1323. One end of the shaft 1321 is connected with the magnetic shell 1322. The magnetic element 1323 is disposed around an inner periphery of the magnetic shell 1322 and located corresponding to the stator structure 131. In particular, the end portion of the shaft 1321 or a portion of the shaft 1321 near the end portion (i.e. the end portion protruding from the magnetic shell 1322, not shown) can connect with the magnetic shell 1322, and this disclosure is not limited. In addition, the stator structure 131 of the motor 13 can be made of silicon steel plates, coils, or other materials, and this disclosure is not limited. Although FIG. 2 shows that the bottom portion of the magnetic shell 1322 protrudes from the bottom portion 1212 of the hub 121, in another embodiment, the bottom portion of the magnetic shell 1322 can be aligned with the bottom portion 1212 of the hub 121 (not shown). This disclosure is not limited. In this embodiment, the fan 1*a* further comprises a circuit board 14 electrically connecting to the stator structure 131 for driving the stator 131.

Figure 4:
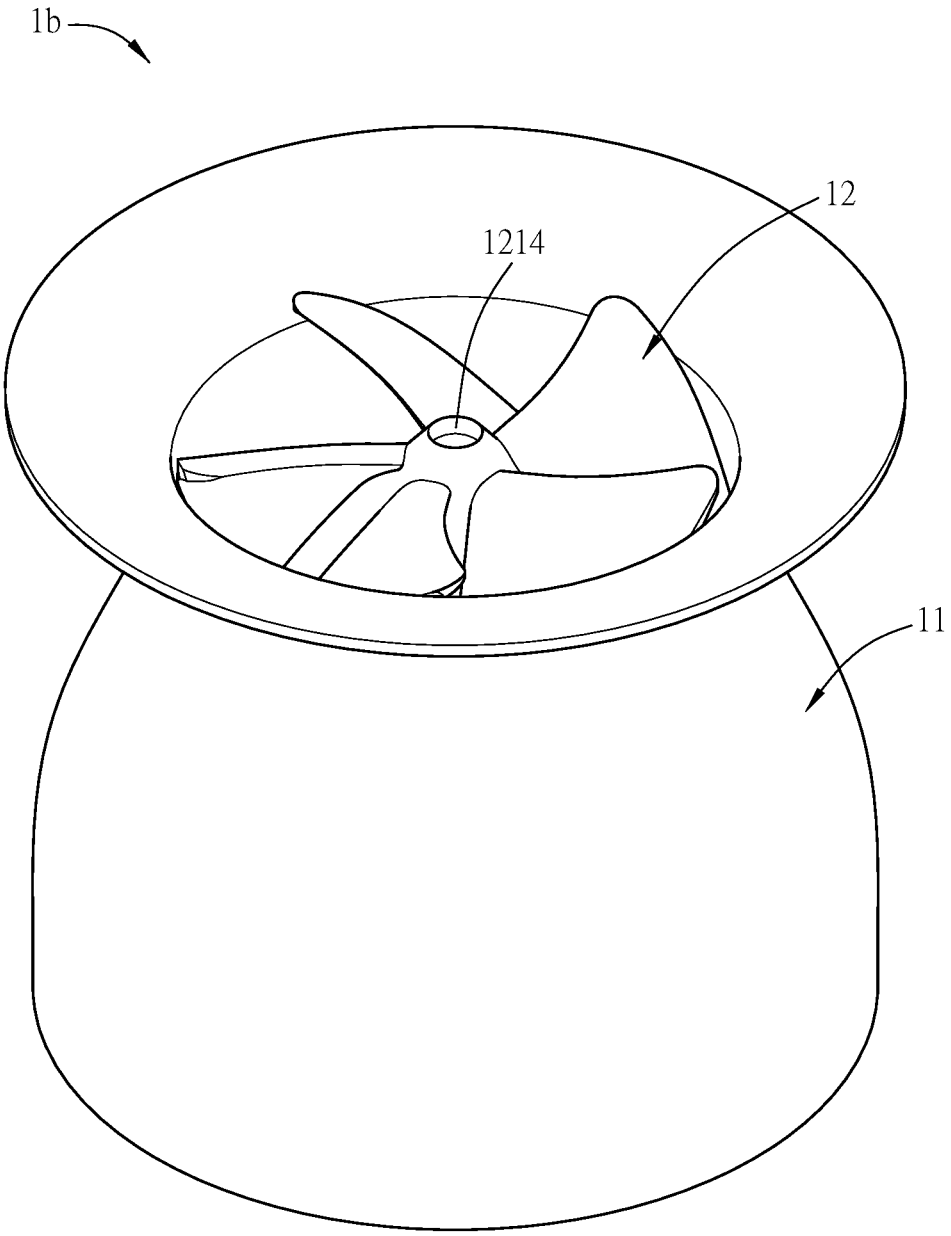
FIG. 4 is a schematic diagram showing a fan according to a second embodiment of this disclosure.
Figure 5:
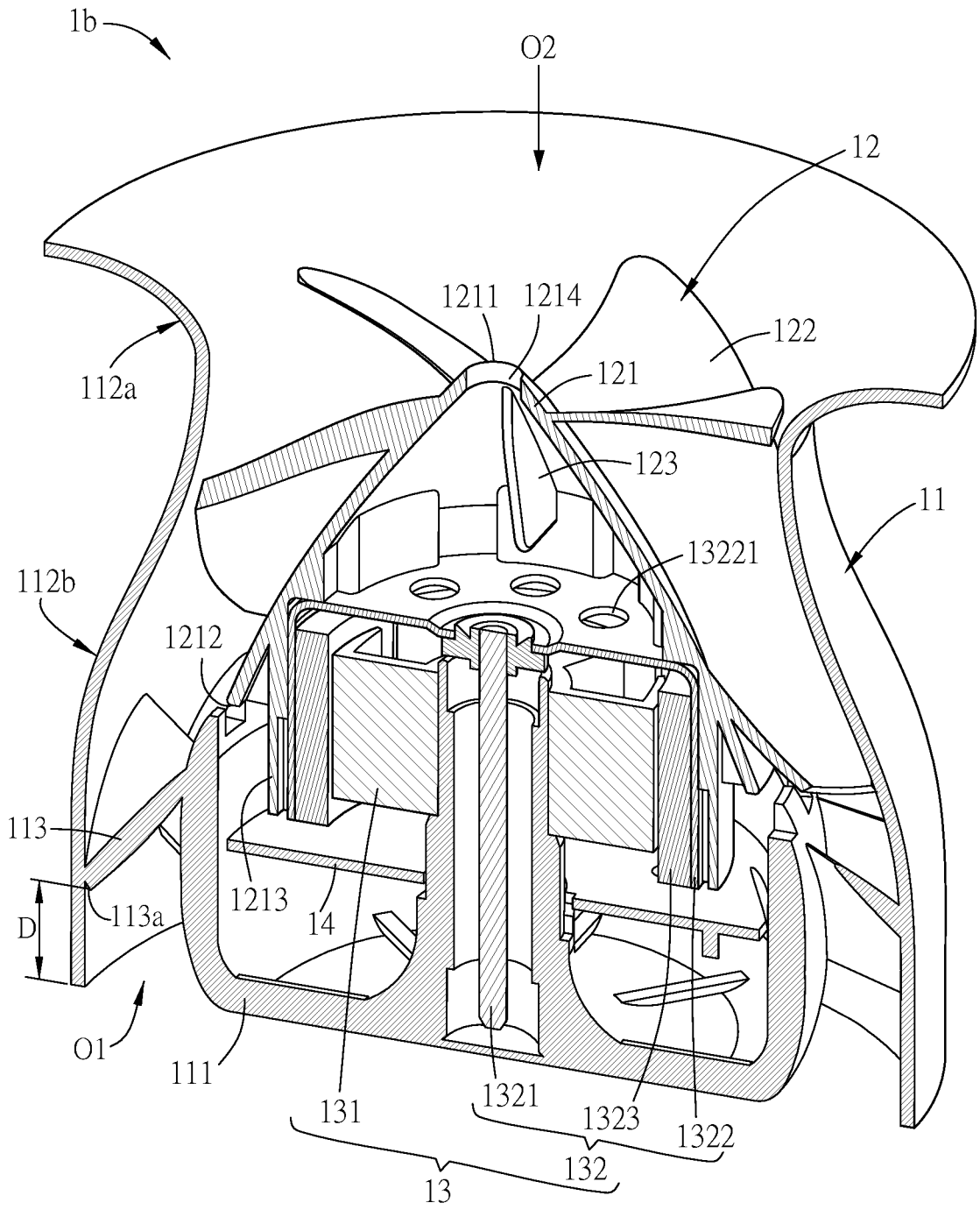
FIG. 5 is a perspective sectional view of the fan of FIG. 4.
Figure 6:
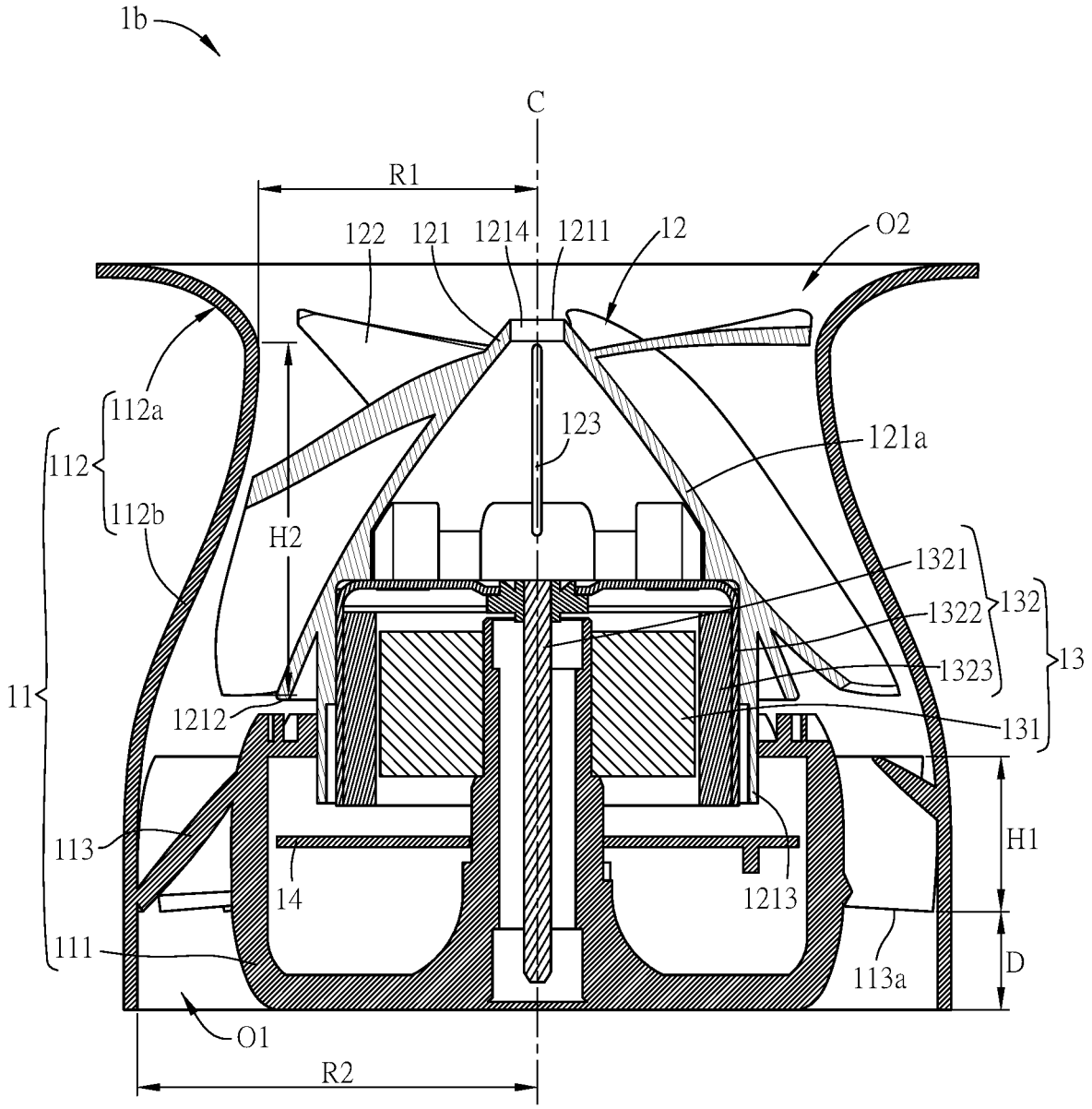
FIG. 6 is a sectional view of the fan of FIG. 4.

FIGS. 4 to 6 are schematic diagrams of a fan 1*b* according to a second embodiment of this disclosure. Referring to FIGS. 4 to 6, the fan 1*b* comprises a frame 11, an impeller 12, and a motor 13. The frame 11 comprises a base 111, a frame housing 112, and a plurality of static blades 113. The frame housing 112 comprises and inlet O2 and an outlet O1, and the static blades 113 are disposed around an outer periphery of the base 111 and connect between the base 111 and the frame housing 112. A distance D is defined between the outlet O1 and the ends 113*a* of the static blades 113 located adjacent to the outlet O1, and the static blades 113 are not protruding from the outlet O1. In other words, the static blades 113 are sunken in the outlet O1. The impeller 12 comprises a hub 121, a plurality of rotor blades 122, and a plurality of guiding plates 123. The hub 121 has a curved surface 121*a*, and the slopes of the straight lines connecting any two points on the curved surface 121*a* are not equal. The hub 121 has at least one airflow opening 1214, which is a through hole and is configured to be flowed through by air. The rotor blades 122 are disposed around an outer periphery of the hub 121, and the guiding plates 123 are disposed around an inner periphery of the hub 121. In particular, although FIG. 6 shows that the hub 121 comprises a top portion 1211, a bottom portion 1212 and an extension portion 1212 protruding from the bottom portion 1212, this disclosure is not limited thereto. In some embodiments, the extension portion 1213 of the hub 121 can be aligned with the bottom portion 1212 of the hub 121 (not shown). In addition, the feature of the curved surface 121*a* of the hub 121, on which the slopes of the straight lines connecting any two points are not equal, can be referred to the above embodiment, so the detailed description thereof will be omitted.

In this embodiment, the motor 13 is disposed on the base 111. The motor 13 connects to the impeller 12 and drives the impeller 12 to rotate. The motor 13 comprises a stator structure 131 and a rotor structure 132. The rotor structure 132 comprises a shaft 1321, a magnetic shell 1322, and a magnetic element 1323. One end of the shaft 1321 is connected with the magnetic shell 1322. The magnetic element 1323 is disposed around an inner periphery of the magnetic shell 1322 and located corresponding to the stator structure 131. A top surface of the magnetic shell 1322 comprises at least an opening 13221. The opening 13221 is a through hole and is configured to be flowed through by air. In particular, the end portion of the shaft 1321 or a portion of the shaft 1321 near the end portion (i.e. the end portion protruding from the magnetic shell 1322, not shown) can connect with the magnetic shell 1322, and this disclosure is not limited. In addition, the number and shape of the opening 13221 can be adjusted according to the actual requirement of the user, and this disclosure is not limited. In this embodiment, when the motor 13 drives the impeller 12 to rotate, the waste heat can be generated and accumulated inside the motor 13 during the operation. The configuration of the opening 13221, which is disposed on the top surface of the magnetic shell 1322, can bring the external air into the motor 13 for enhancing the heat dissipation of the waste heat, thereby improving the self-heat dissipation efficiency. In particular, the stator structure 131 of the motor 13 can be made of silicon steel plates, coils, or other materials, and this disclosure is not limited. Although FIGS. 5 and 6 show that the bottom portion of the magnetic shell 1322 protrudes from the bottom portion 1212 of the hub 121, this disclosure is not limited thereto. In another embodiment, the bottom portion of the magnetic shell 1322 can be aligned with the bottom portion 1212 of the hub 121 (not shown).

In this embodiment, two ends of the frame housing 112 disposed adjacent to the rotor blades 122 have a first curved portion 112*a* and a second curved portion 112*b*, respectively, and curvatures of the first curved portion 112*a* and the second curved portion 112*b* are different. An airflow entering the fan 1*b* passes through the inlet O2, the first curved portion 112*a*, the second curved portion 112*b*, and the outlet O1 sequentially. The design of the frame housing 112 with two different curvatures can concentrate the airflow and apply a pressure in the radial direction. Accordingly, the internal flow field inside the frame can be stable and can still provide sufficient air pressure and air quantity, thereby improving the operation performance of the fan.

In this embodiment, the fan 1 further comprises a circuit board 14 electrically connecting with the stator structure 131 for driving the stator structure 131.

In this embodiment, the hub 121 comprises one airflow opening 1214 for example, and the airflow opening 1214 is a through hole and is disposed on the top portion 1211 of the hub 121. Accordingly, the airflow opening 1214 is located facing the inlet O2 of the fan 1. Since the airflow opening 1214 is a through hole, the air can flow through the airflow opening 1214 and enter the internal space of the hub 121. In addition, the configuration of the guiding plates 123 can increase the air flowing inside the hub 121, thereby increasing the self-heat dissipation efficiency. In particular, the number and shape of the airflow opening 1214 can be adjusted according to the actual requirement of the user, and this disclosure is not limited.

The detailed configurations of the guiding plates 123 will be described with reference to FIGS. 6 and 7A to 7D. The guiding plates 123 are disposed around the inner periphery of the hub 121 and extending along the direction L towards the axis c of the hub 121. In other words, the guiding plates 123 are perpendicular to the inner periphery of the hub 121.

In particular, although FIGS. 6 and 7A to 7D show that the guiding plates 123 are disposed perpendicular to the inner periphery of the hub 121 (the included angle between the guiding plate 123 and the inner periphery of the hub 121 is 90 degrees), this disclosure is not limited thereto. In some embodiments, the included angle between guiding plate 123 and the inner periphery of the hub 121 can be 20 degrees, 45 degrees or other angles according to the actual requirement of the user.

In this embodiment, each of the guiding plates 123 is configured as a rib structure, but this disclosure is not limited thereto. For example, the guiding plate 123 can be configured as a wing structure (not shown).

Figure 7A:
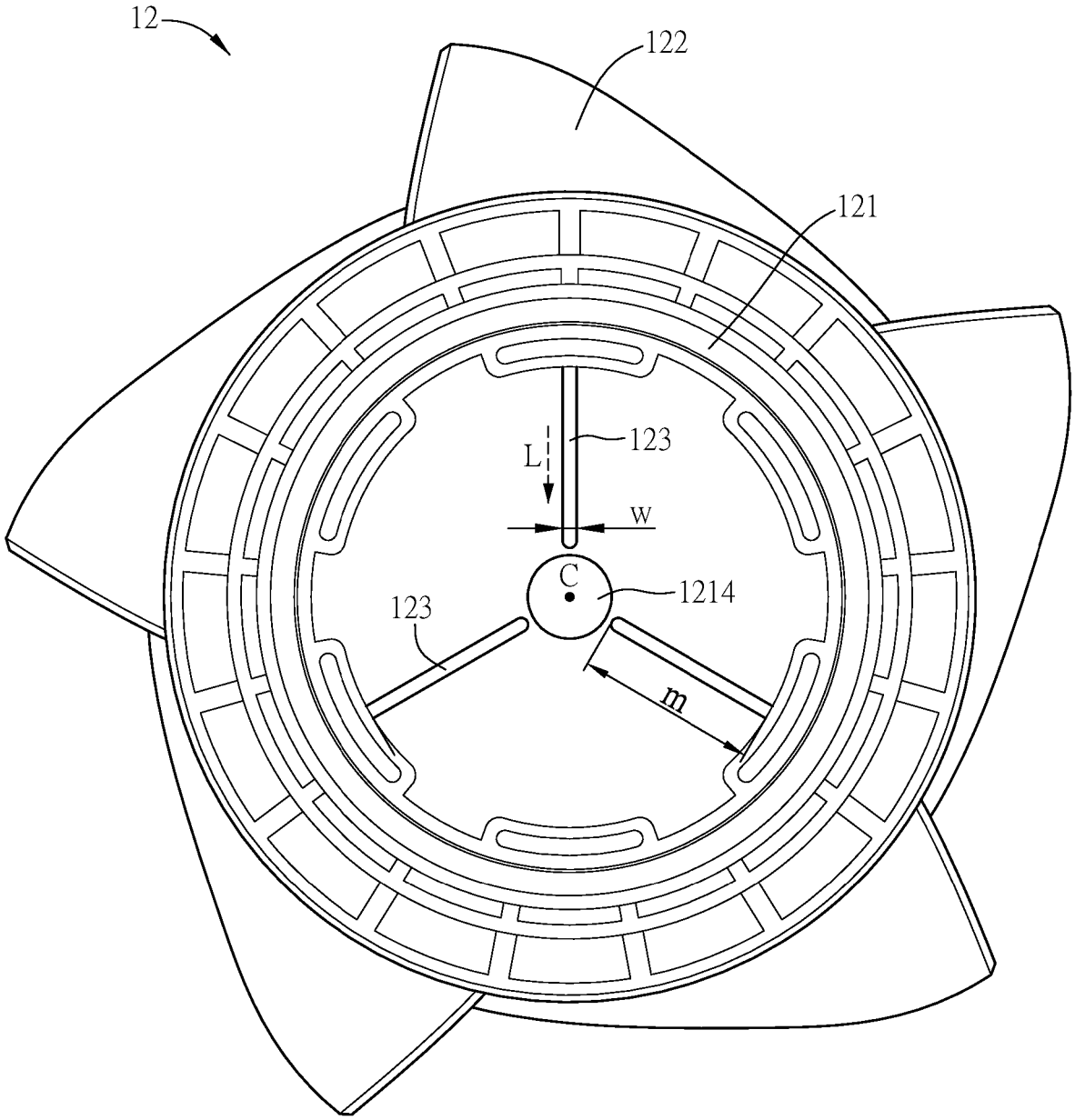
FIG. 7A is a top view of the impeller of FIG. 4.

In this embodiment, as shown in FIG. 7A, the guiding plates 123 are separately disposed on the inner periphery of the hub 121 with equivalent angles. Alternatively, as shown in FIG. 7, the guiding plates 123 are separately disposed on the inner periphery of the hub 121 with inequivalent angles.

Figure 7B:
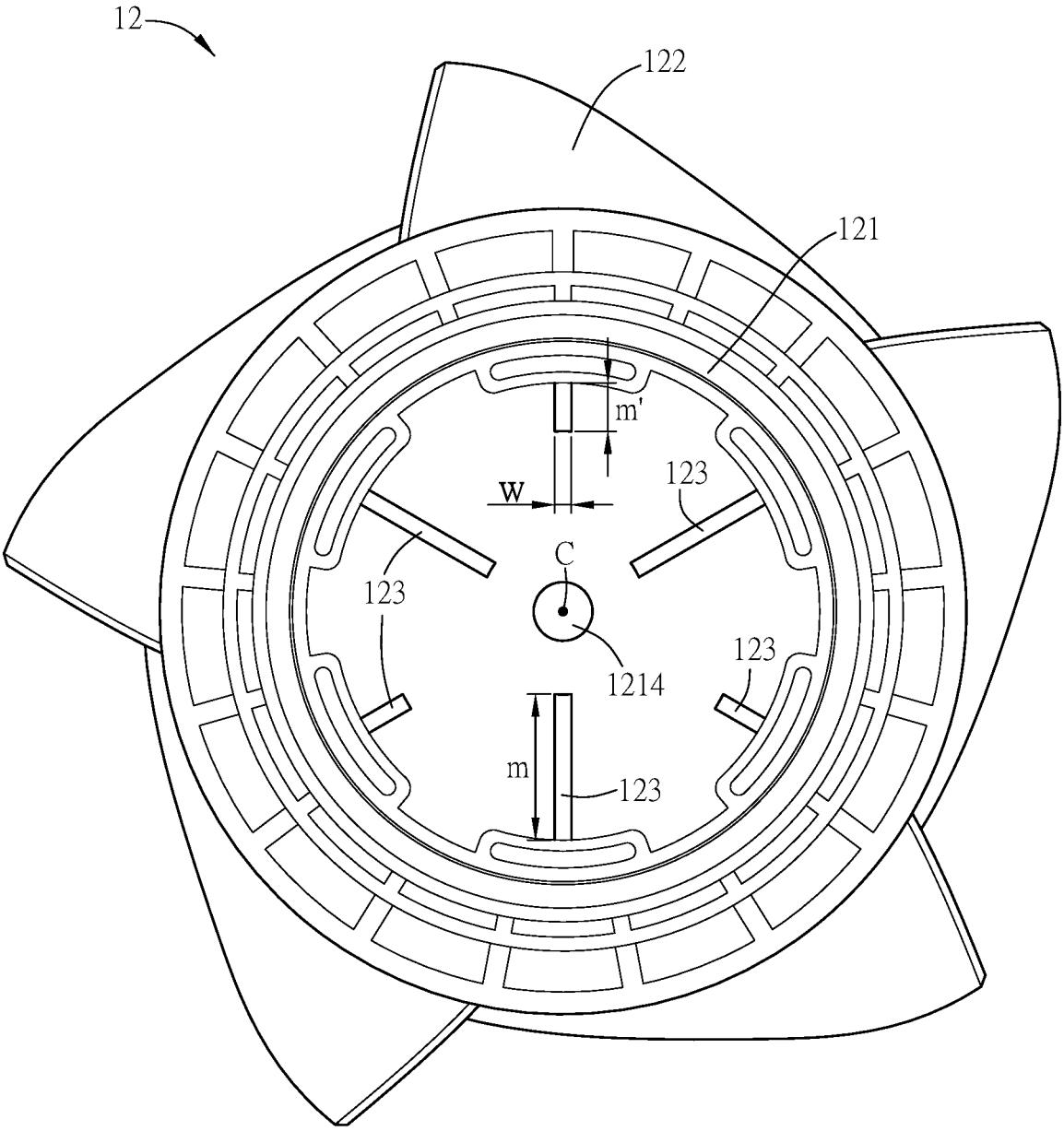
FIG. 7B is another top view of the impeller of FIG. 4.
Figure 7C:
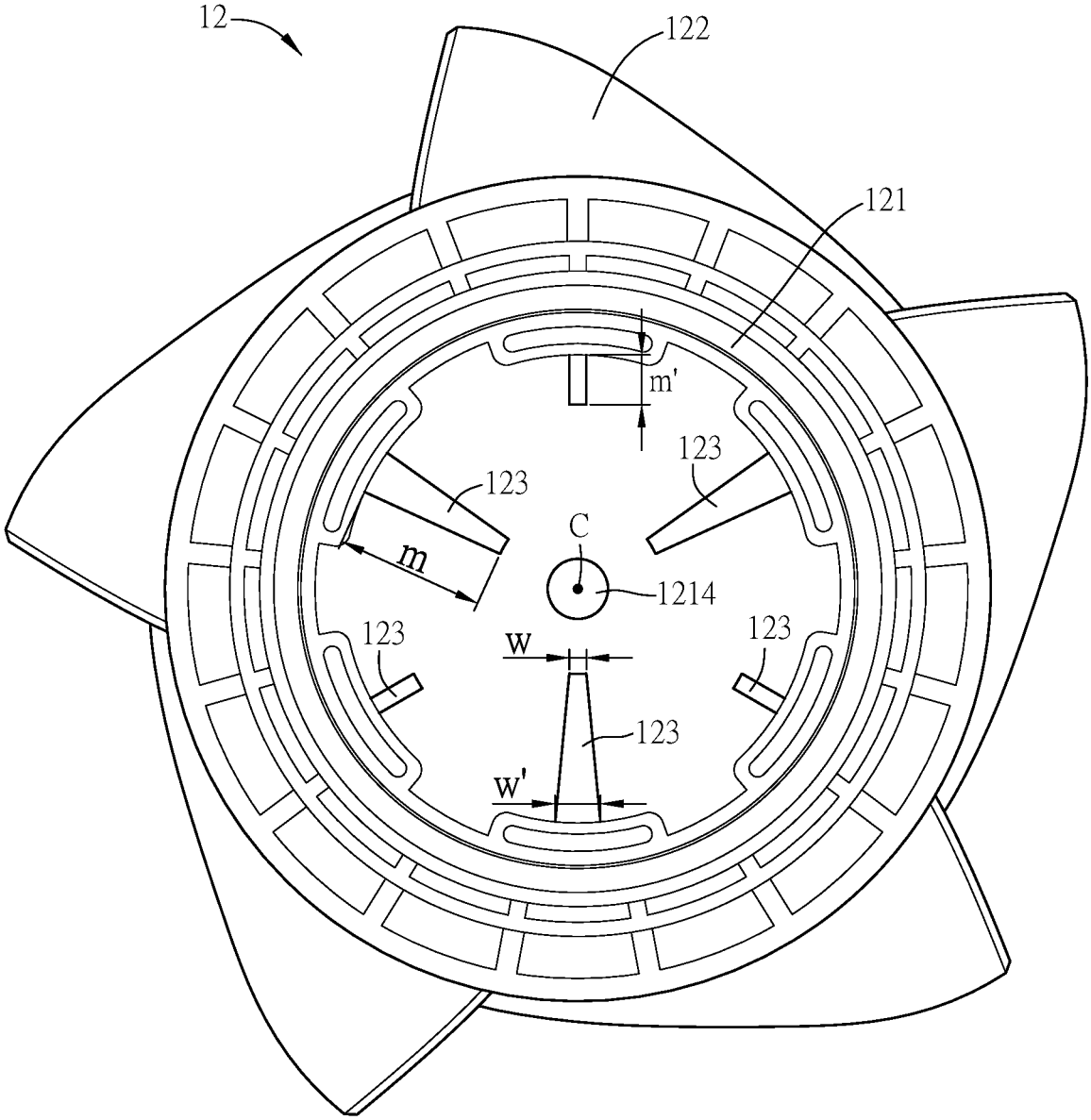
FIG. 7C is another top view of the impeller of FIG. 4.
Figure 7D:
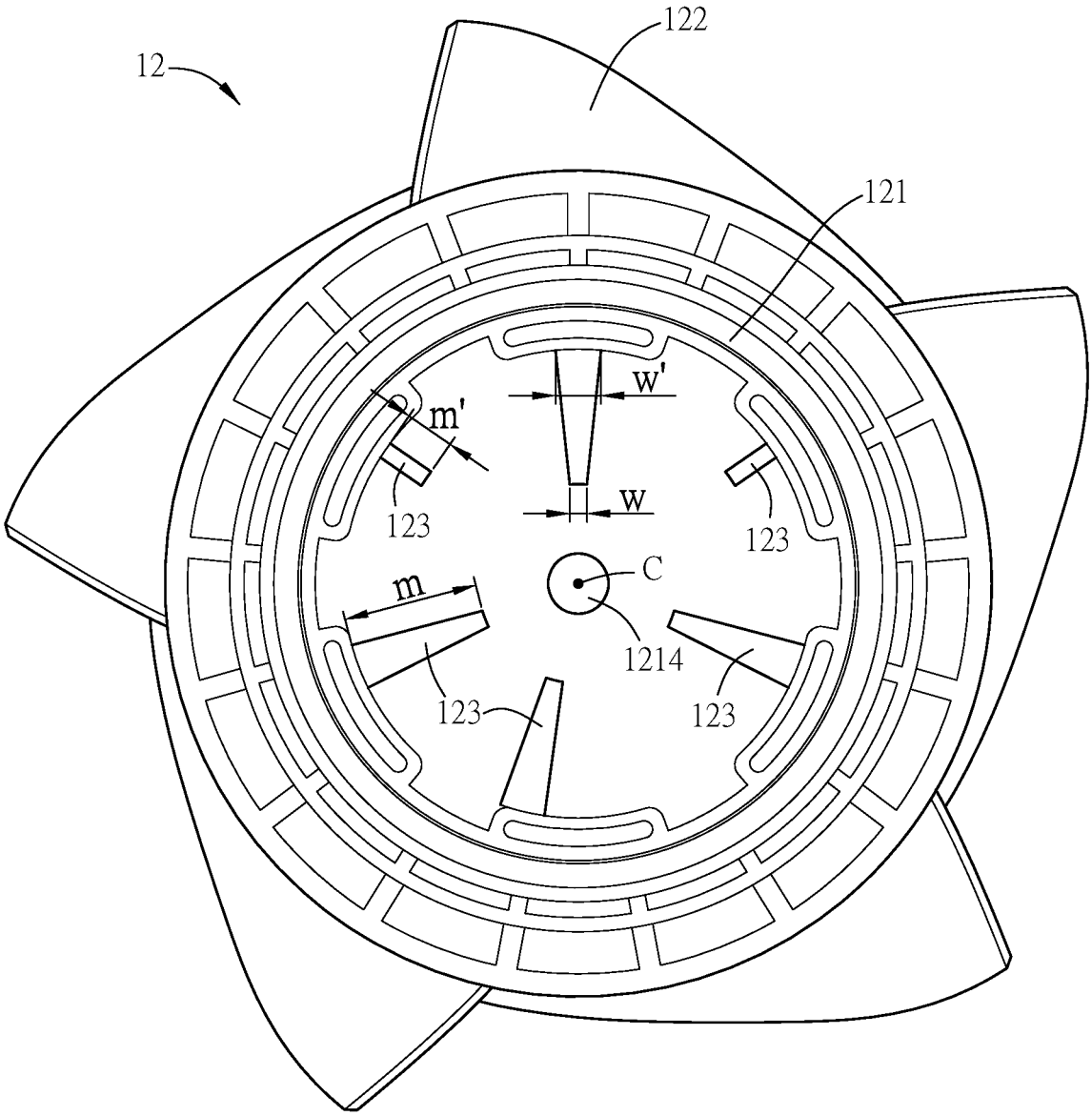
FIG. 7D is another top view of the impeller of FIG. 4.

In this embodiment, the lengths m, thicknesses w, heights or shapes of the guiding plates 123 can be the same or different. As shown in FIG. 7A, the guiding plates 123 have the same lengths m, thicknesses w, heights (not shown), or shapes. As shown in FIG. 7B, the guiding plates 123 have different lengths m and m'. As shown in FIG. 7C, the guiding plates 123 have different lengths m and m', thicknesses w and w', and shapes. As shown in FIG. 7D, the guiding plates 123 have different lengths m and m', thicknesses w and w', and shapes, and the guiding plates 123 are separately disposed with inequivalent angles. Moreover, the guiding plates 123 have different heights (not shown). In particular, the configured angles, lengths m, thicknesses w, heights or shapes of the guiding plates 123 can be adjusted according to the actual requirement of the user, and this disclosure is not limited. In this embodiment, the guiding plates 123 can guide the airflow from the airflow opening 1214 to the opening 13221 disposed on the top surface of the magnetic shell 1322. Then, the airflow can carry and dissipate the waste heat from the motor, thereby enhancing the self-heat dissipation efficiency of the fan.

Referring to FIG. 6, in this embodiment, a radius distance R2 between the second curved portion 112*b* and the axis c of the hub 12 is greater than a radius distance R1 between the first curved portion 112*a* and the axis c of the hub 12. The frame housing 112 has a gradual-narrowed structure from the inlet O2 to the first curved portion 112*a*, and the gradual-narrowed structure comprises at least an arc surface, at least a curved surface, at least a planar surface, at least a slant surface, or any of their combinations. In addition, the frame housing 112 has a gradual-expanded structure from the first curved portion 112*a* to the second curved portion 112*b*, and the gradual-expanded structure comprises at least an arc surface, at least a curved surface, at least a planar surface, at least a slant surface, or any of their combinations. The design of the first curved portion 112*a* and the second curved portion 112*b* of the frame housing 112 can concentrate the airflow and apply a pressure in the radial direction. Accordingly, the flow field inside the frame can be stable and can still provide sufficient air pressure and air quantity, thereby increasing the operation performance of the fan. In particular, although FIG. 5 shows that the gradual-narrowed structure and the gradual-expanded structure are made of curved surface, this disclosure is not limited thereto. In other embodiments, the gradual-narrowed structure and the gradual-expanded structure can comprise arc surfaces, curved surfaces, planar surfaces, slant surfaces, or any of their combinations.

Figure 8A:
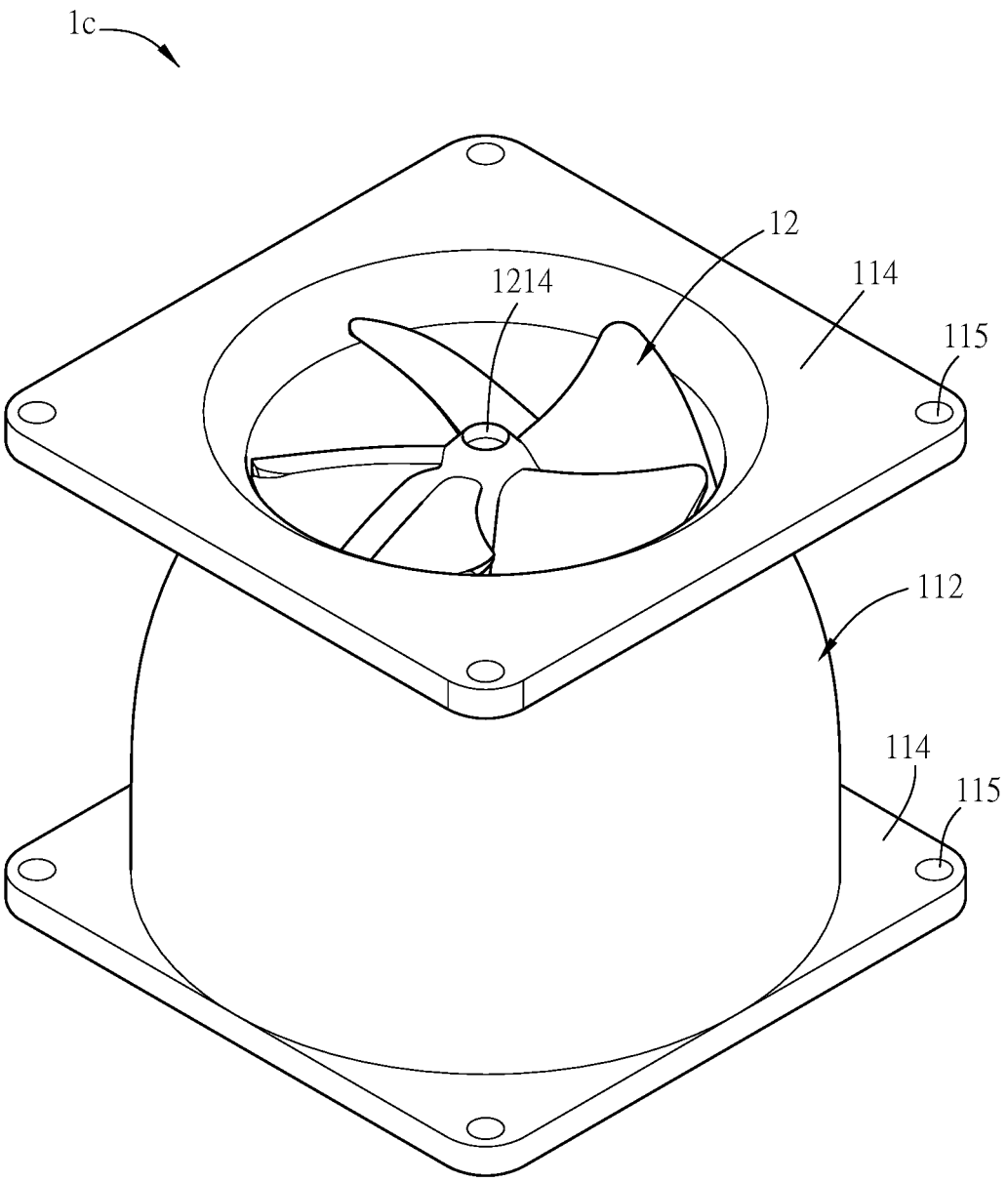
FIG. 8A is a schematic diagram showing a fan according to a third embodiment of this disclosure.
Figure 8B:
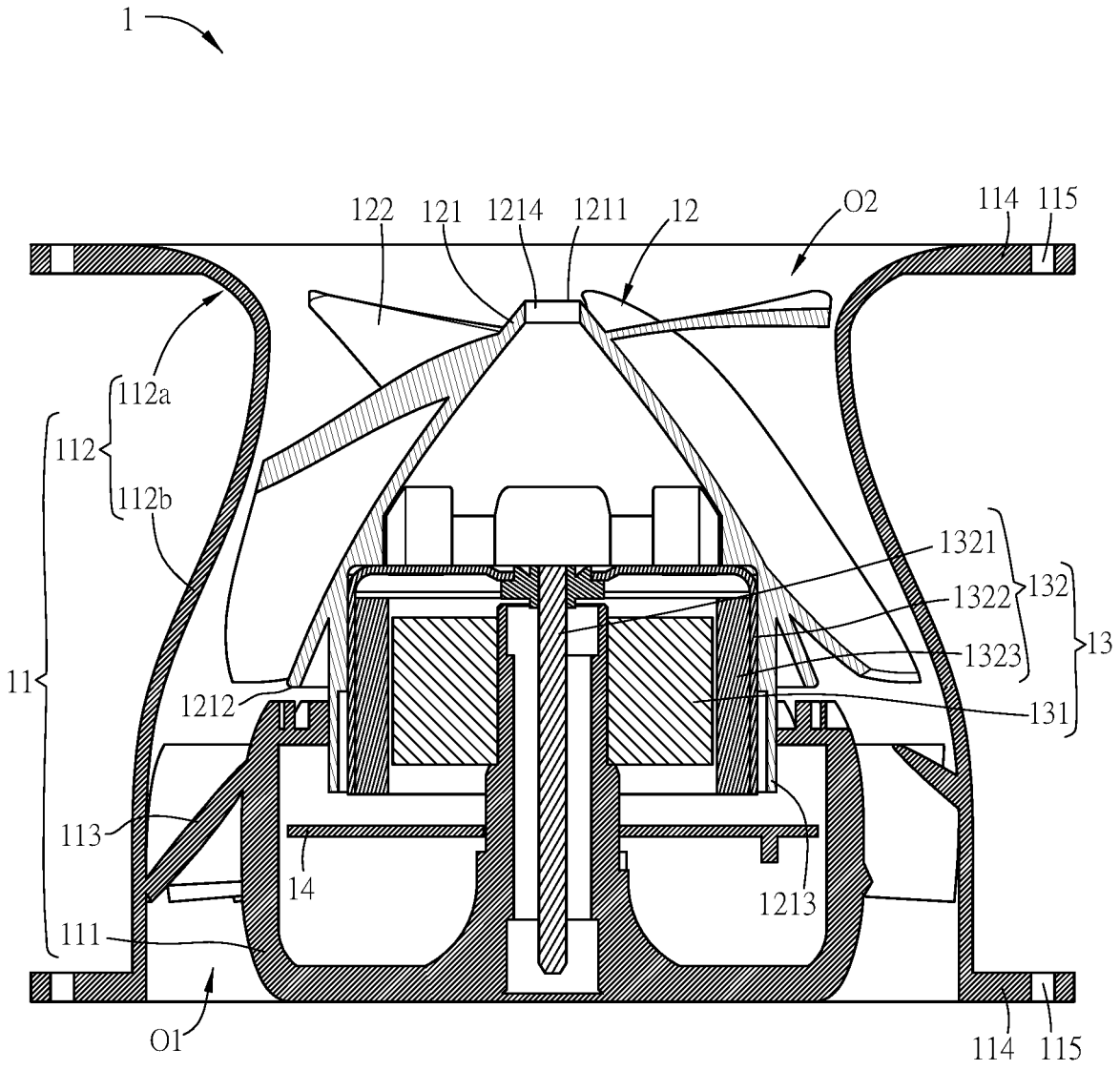
FIG. 8B is a sectional view of the fan of FIG. 8A.

FIG. 8A is a schematic diagram showing a fan 1*c* according to a third embodiment of this disclosure, and FIG. 8B is a sectional view of the fan of FIG. 8A. The structure, components, function of the fan 1*c* are mostly the same as the fan 1*a* or 1*b* of the above embodiments. Different from the previous embodiments, the frame housing 112 of the fan 1*c* of the third embodiment further comprises an extension portion 114 and an installation portion 115. The fan 1*c* may comprise all components in the above-mentioned fan 1*a* or 1*b*, and vice versa. The same structure, components and function are not repeated here. In this embodiment, the frame housing 112 further comprises an extension portion 114 and an installation portion 115. The extension portions 114 are disposed on the inlet O2 and the outlet O1 and are connected with the frame housing 112, and the installation portions 115 are disposed on the extension portions 114. For example, the configuration of the extension portions 114 and the installation portions 115 allow to fix the fan 1*c* on any of other structures, such as, for example but not limited to, the electronic devices that can easily generate heat. To be noted, in this embodiment, the extension portions 114 disposed on the inlet O2 and the outlet O1 are square, and four installation portions 115 are disposed on each extension portion 114, but this disclosure is not limited thereto. In other embodiments, the shape of the extension portions 114 and the amount of the installation portions 115 can be adjusted based on the requirement of the user.

Figure 9:
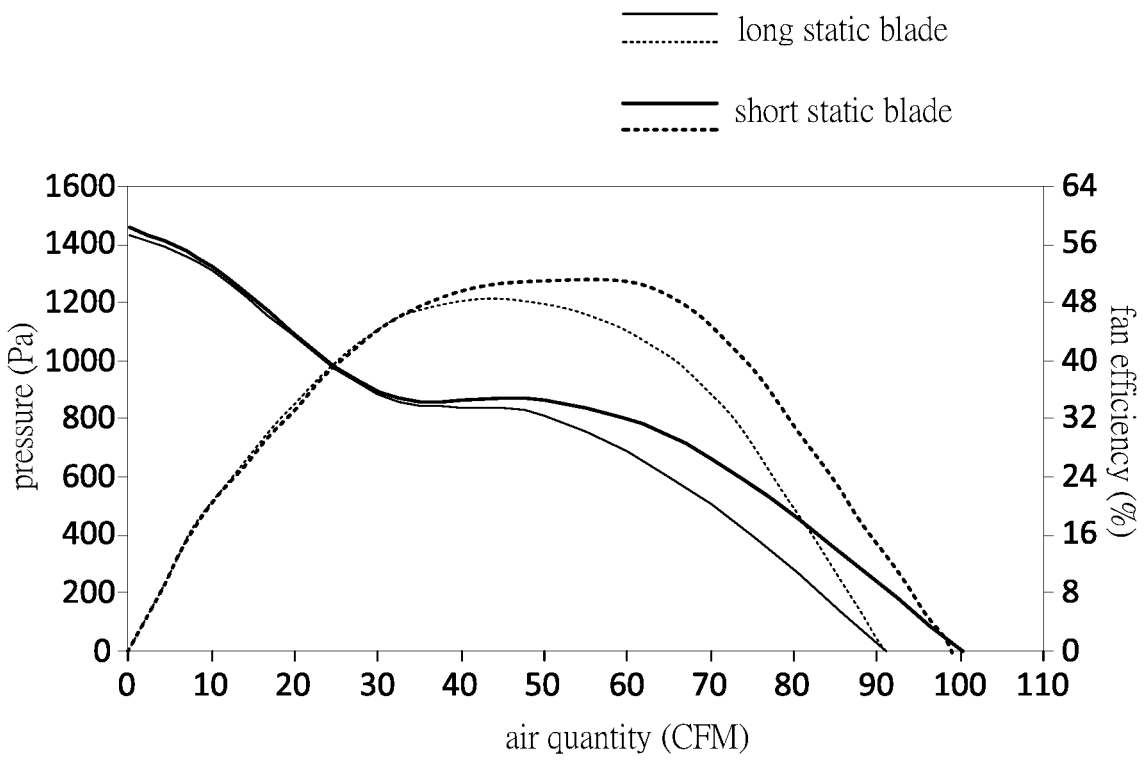
FIG. 9 is a schematic graph showing the relations between the fan efficiency and the heights of the rotor blades and static blades of this disclosure.

Referring to FIG. 6, in the first to third embodiments, a ratio of the height H1 of the static blades 113 to the height H2 of the rotor blades 122 is less than or equal to 0.5. Herein, the height H1 of the static blades 113 is greater than or equal to 8 mm. In addition, a ratio of the distance D between the outlet O1 and the ends 113*a* of the static blades 113 located adjacent to the outlet O1 to the height H1 of the static blades 113 is less than or equal to 0.5. For example, as shown in FIG. 9 (in view of FIG. 6), a fan with short static blades and a fan with long static blades are selected in this experiment. In the fan with short static blades, the distance D is defined between the outlet O1 and the ends 113*a* of the static blades 113 located adjacent to the outlet O1; in the fan with long static blades, no gap is defined between the outlet and the ends of the static blades located adjacent to the outlet. In other words, in the fan with short static blades, the static blades 113 are sunken in the outlet O1 (referring to the above embodiments), and in the fan with long static blades, the end portions of the static blades are aligned with the outlet. The ratio of the height of the static blades to the rotor blades in the fan with short static blades is H1/H2, and the ratio of the height of the static blades to the rotor blades in the fan with long static blades is (H1+D)/H2. The two fans all comprise 17 static blades, a rotation speed of 13,500 RPM, and a frame size of 80 mm×80 mm×56 mm. The fan characteristics and fan efficiencies of the two fans are measured. In this experiment, H1/H2=0.4, (H1+D)/H2=0.545, and D/H1=0.145. As shown in FIG. 9, under the same air quantity, the fan with short static blades can generate a larger air pressure (referred to the solid line) and a higher fan efficiency (referred to the dotted line). As a result, compared with the fan with long static blades, the fan with short static blades, which has the distance D between the outlet O1 and the ends 113*a* of the static blades 113 located adjacent to the outlet O1, can have higher air pressure and fan efficiency.

Figure 10:
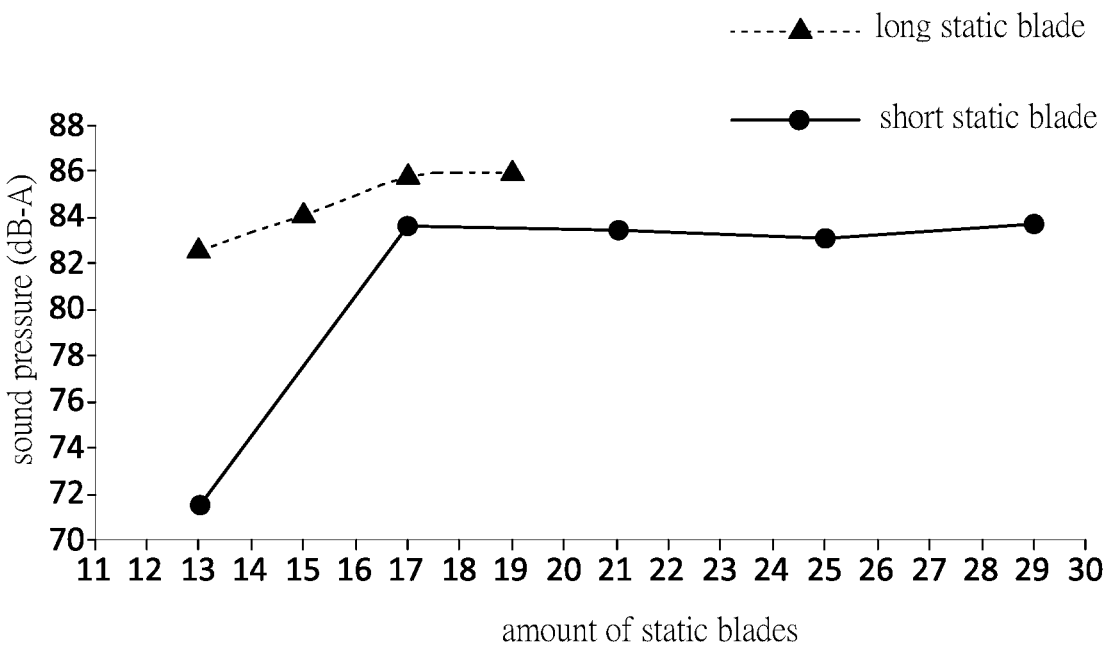
FIG. 10 is a schematic graph showing the relations between the fan noise and the density of the blades of this disclosure.

In addition, as shown in FIG. 10, a fan with short static blades and a fan with long static blades are selected in this experiment. The heights of the static blades and the rotor blades of the fan with short static blades and the fan with long static blades in FIG. 10 are the same as those shown in FIG. 9, so the detailed descriptions thereof will be omitted. The two fans all comprise a rotation speed of 13,500 RPM and a frame size of 80 mm×80 mm×56 mm. The fan characteristics and fan efficiencies of the two fans are measured. The two fans are configured with different amounts of static blades, and the sound pressures (noise) thereof are measured. As shown in FIG. 10, under the same amount of static blades, the fan with short static blades has lower sound pressure, and the fan with long static blades has higher sound pressure. As a result, compared with the fan with long static blades, the fan with short static blades, which has the distance D between the outlet O1 and the ends 113*a* of the static blades 113 located adjacent to the outlet O1 (the static blades 113 are sunken in the outlet O1), can decrease the noise generated during the fan operation. In addition, if the static blades 113 are configured with holes, the generated noise can be further decreased.

Figure 11:
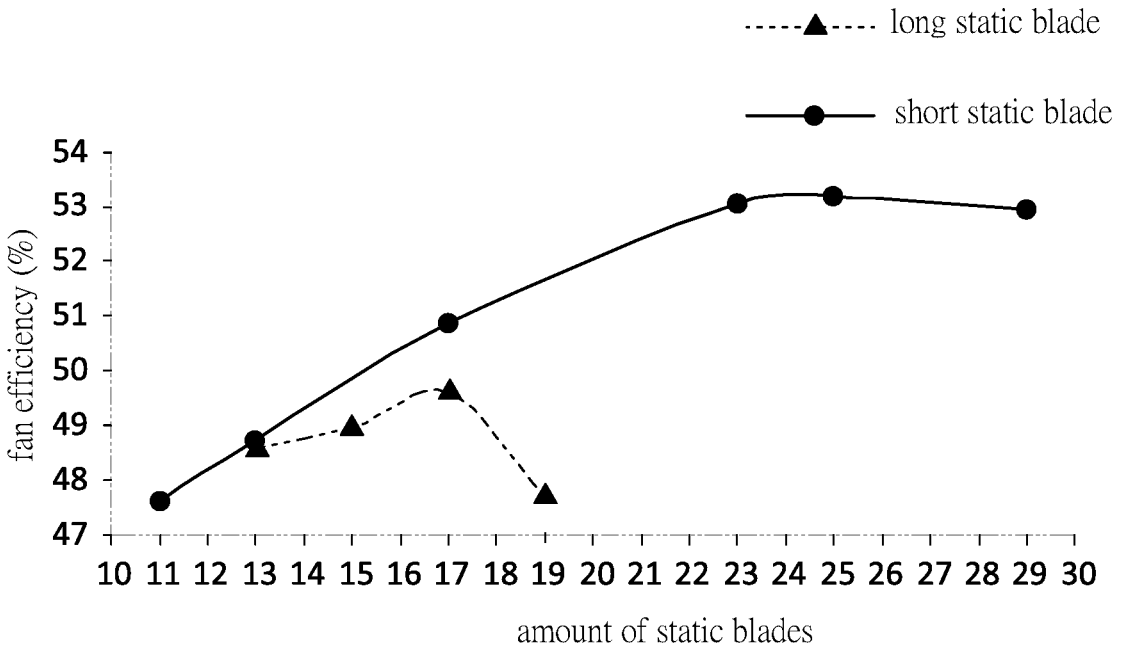
FIG. 11 is a schematic graph showing the relations between the fan efficiency and the density of the blades of this disclosure.

Referring to FIG. 6, in the above-mentioned first to third embodiments, the amount of the static blades 113 is greater than or equal to 19, and a ratio of the amount of the static blades 113 to the amount of the rotor blades 122 is greater than or equal to 1.5. For example, since the distance D is configured between the outlet O1 and the ends 113*a* of the static blades 113 located adjacent to the outlet O1 (the static blades 113 are sunken in the outlet O1), it is possible to increase the density of the configured static blades 113 (to be 19 or more), thereby further increasing the fan efficiency. As shown in FIG. 11, a fan with short static blades and a fan with long static blades are selected in this experiment. The heights of the static blades and the rotor blades of the fan with short static blades and the fan with long static blades in FIG. 11 are the same as those shown in FIG. 9, so the detailed descriptions thereof will be omitted. The two fans all comprise a rotation speed of 13,500 RPM and a frame size of 80 mm×80 mm×56 mm. The two fans are configured with different amounts of static blades, and the fan efficiencies thereof are measured. As shown in FIG. 11, under the same rotation speed, the amount of static blades in the fan with short static blades can be increased to 23 or more, and the fan efficiency is enhanced as the amount of static blades is increased. However, the amount of the static blades in the fan with long static blades cannot be more than 19, and the maximum fan efficiency is referred to the case with 17 static blades. In addition, the fan efficiency of the fan with long static blades is lower than that of the fan with short static blades. As a result, compared with the fan with long static blades, the fan with short static blades, which has the distance D between the outlet O1 and the ends 113*a* of the static blades 113 located adjacent to the outlet O1 (the static blades 113 are sunken in the outlet O1), can increased the amount of configured static blades and the fan efficiency.

In summary, the fan of this disclosure has a distance D between the outlet O1 and the ends 113*a* of the static blades 113 located adjacent to the outlet O1 (the static blades 113 are sunken in the outlet O1). This design can enhance the fan characteristics of the mixed flow fan and reduce the operation noise. The design of sunken static blades 113 in the outlet O1 can also increase the density of the static blades 113, thereby further improving the fan characteristics of the mixed flow fan. In addition, at least an airflow opening 1214 is formed on the hub 12, a plurality of guiding plates 123 are disposed around the inner periphery of the hub 12, and at least an opening 13221 is disposed on the top surface of the magnetic shell 1322. These configurations can increase the self-heat dissipation efficiency inside the fan. Moreover, the configuration of the first curved portion 112*a* and the second curved portion 112*b* can concentrate the airflow and apply a pressure in the radial direction. In addition, the hub 12 is designed as a gradual-expanded shape, so that the impacts between the airflow and the internal components of the fan can be reduced. Accordingly, the internal flow field of the fan can be stable and can still provide sufficient air pressure and air quantity. This can decrease the operation noise of the fan and increase the operation performance of the fan.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan, comprising:

a frame comprising a base, a frame housing and a plurality of static blades, wherein the frame housing comprises an inlet and an outlet, the static blades are disposed around an outer periphery of the base and connect between the base and the frame housing, a distance is defined between the outlet and ends of the static blades located adjacent to the outlet, and the static blades are not protruding from the outlet;

an impeller comprising:

a hub having a curved surface, wherein slopes of straight lines connecting any two points on the curved surface are not equal, and the hub has at least an airflow opening, a plurality of rotor blades disposed around an outer periphery of the hub, and a plurality of guiding plates disposed around an inner periphery of the hub; and a motor disposed on the base, wherein the motor connects with and drives the impeller to rotate, and comprises:

a stator structure, and a rotor structure comprising a shaft, a magnetic shell and a magnetic element, wherein one end of the shaft is connected with the magnetic shell, the magnetic element is disposed around an inner periphery of the magnetic shell and located between the stator structure and the magnetic shell, and a top surface of the magnetic shell comprises at least an opening;

wherein, two ends of the frame housing disposed adjacent to the rotor blades have a first curved portion and a second curved portion, respectively, curvatures of the first curved portion and the second curved portion are different, and an airflow entering the fan passes through the inlet, the first curved portion, the second curved portion and the outlet sequentially.

2. The fan according to claim 1, wherein a number of the static blades is greater than or equal to 19.

3. The fan according to claim 1, wherein a ratio of a number of the static blades to a number of the rotor blades is greater than or equal to 1.5.

4. The fan according to claim 1, wherein a ratio of a height of the static blades to a height of the rotor blades is less than or equal to 0.5.

5. The fan according to claim 4, wherein the height of the static blades is greater than or equal to 8 mm.

6. The fan according to claim 5, wherein a ratio of the distance to the height of the static blades is less than or equal to 0.5.

7. The fan according to claim 1, wherein the airflow opening is disposed at a top portion of the hub.

8. The fan according to claim 1, wherein the guiding plates are separately disposed with equivalent angles.

9. The fan according to claim 1, wherein the guiding plates are separately disposed with inequivalent angles.

10. The fan according to claim 1, wherein the guiding plates have the same lengths, thicknesses, heights, or shapes.

11. The fan according to claim 1, wherein the guiding plates are different in at least one of lengths, thicknesses, heights and shapes.

12. The fan according to claim 1, wherein a radius distance between the second curved portion and an axis of the hub is greater than a radius distance between the first curved portion and the axis of the hub.

13. The fan according to claim 1, wherein the frame housing has a gradual-narrowed structure from the inlet to the first curved portion, and the gradual-narrowed structure comprises at least an arc surface, at least a curved surface, at least a planar surface, at least a slant surface, or any of their combinations.

14. The fan according to claim 1, wherein the frame housing has a gradual-expanded structure from the first curved portion to the second curved portion, and the gradual-expanded structure comprises at least an arc surface, at least a curved surface, at least a planar surface, at least a slant surface, or any of their combinations.

* * * * *